US011111093B2

(12) United States Patent
Ichikawa

(10) Patent No.: US 11,111,093 B2
(45) Date of Patent: Sep. 7, 2021

(54) SHEET CONVEYOR AND IMAGE FORMING APPARATUS

(71) Applicant: Brother Kogyo Kabushiki Kaisha, Nagoya (JP)

(72) Inventor: Hiroshi Ichikawa, Okazaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 61 days.

(21) Appl. No.: 16/247,767

(22) Filed: Jan. 15, 2019

(65) Prior Publication Data

US 2019/0233230 A1 Aug. 1, 2019

(30) Foreign Application Priority Data

Jan. 26, 2018 (JP) ..... JP2018-011958

(51) Int. Cl.
*B65H 3/52* (2006.01)
*B65H 5/06* (2006.01)
(Continued)

(52) U.S. Cl.
CPC ..... *B65H 5/062* (2013.01); *B65H 3/0669* (2013.01); *B65H 3/0684* (2013.01); *B65H 3/34* (2013.01);
(Continued)

(58) Field of Classification Search
CPC ..... B65H 3/34; B65H 3/0669; B65H 3/5261; B65H 3/5284; B65H 5/062; B65H 2403/72; B65H 2403/724
See application file for complete search history.

(56) References Cited

U.S. PATENT DOCUMENTS 6,913,257 B2 * 7/2005 Takaki ..... H04N 1/00909 271/10.13
8,678,372 B2 * 3/2014 Yasukawa ..... B65H 7/12 271/10.09
(Continued)

FOREIGN PATENT DOCUMENTS

JP H11-246067 A 9/1999
JP 2010-208757 A 9/2010
(Continued)

OTHER PUBLICATIONS

Translation of JP 2013-180894 (Year: 2020).*

*Primary Examiner* — Howard J Sanders
(74) *Attorney, Agent, or Firm* — Burr & Brown, PLLC

(57) ABSTRACT

A sheet conveyor includes a separation roller, a retard roller forming a nip with the separation roller, and a load application device configured to apply a load to the retard roller. The load application device includes a motor, a first drive train, a second torque limiter isolated from the first drive train, and a controller. The first drive train includes a plurality of gears for transmitting a driving force from the motor to the retard roller, a first torque limiter, and a clutch disposed between the motor and the first torque limiter. The second torque limiter is configured to communicate with the retard roller. The controller is configured to, during conveyance of a sheet, control the clutch to allow transmission of the driving force from the motor for a predetermined time period and to interrupt transmission of the driving force from the motor after expiration of the predetermined time period.

14 Claims, 12 Drawing Sheets

(51) Int. Cl.
*B65H 3/34* (2006.01)
*B65H 3/06* (2006.01)

(52) U.S. Cl.
CPC ..... *B65H 3/5261* (2013.01); *B65H 3/5284* (2013.01); *B65H 2403/72* (2013.01); *B65H 2403/724* (2013.01)

(56) References Cited

U.S. PATENT DOCUMENTS

| | | | | |
|---|---|---|---|---|
| 2002/0021926 | A1* | 2/2002 | Yamamoto | B41J 35/28 400/120.1 |
| 2013/0241144 | A1 | 9/2013 | Yasukawa | |
| 2013/0241145 | A1* | 9/2013 | Yasukawa | B65H 3/5261 271/272 |
| 2016/0251178 | A1 | 9/2016 | Kuriki | |
| 2020/0262665 | A1* | 8/2020 | Lee | B65H 3/5284 |

FOREIGN PATENT DOCUMENTS

| | | | | |
|---|---|---|---|---|
| JP | 2013-193837 | A | | 9/2013 |
| JP | 2013-193838 | A | | 9/2013 |
| JP | 2013180894 | A | * | 9/2013 |
| JP | 2016-159989 | A | | 9/2016 |

* cited by examiner

SHEET CONVEYOR AND IMAGE FORMING APPARATUS

CROSS-REFERENCE TO RELATED APPLICATION

This application claims priority from Japanese Patent Application No. 2018-011958 filed on Jan. 26, 2018, the content of which is incorporated herein by reference in its entirety.

FIELD OF DISCLOSURE

Aspects described herein relate to a sheet conveyor and an image forming apparatus.

BACKGROUND

Generally, image reading apparatuses, image forming apparatuses, copying machines, and other imaging apparatuses use various sheet conveyors to separate single sheets from a stack of sheets and feed a single sheet at a time.

One of the sheet conveyors uses a retard roller with a torque limiter for high performance in sheet separation. The sheet conveyor includes a feed roller, the retard roller forming a nip with the feed roller, a first motor to drive the feed roller, and a second motor to drive the retard roller. The retard roller is connected via the torque limiter to a shaft.

To feed a single sheet, the feed roller and the retard roller rotate in a feed direction in which each roller feeds a sheet. When one or more sheets are picked at a time, the retard roller is configured to rotate in a direction opposite to the feed direction to separate a single sheet in contact with the feed roller from remaining sheets and return the remaining sheets upstream in the feed direction. When a single sheet is separated from sheets being fed at a time, transmission of the driving force to the retard roller is interrupted. The retard roller receives rotation of the feed roller via the single sheet, and thus rotates in the feed direction under the action of toque of the torque limiter to feed the single sheet in the feed direction with the feed roller.

SUMMARY

During conveyance of a single sheet, the retard roller conveys the sheet under the action of torque of the torque limiter. The torque acts as a conveyance resistance to the sheet.

Illustrative aspects of the disclosure provide a sheet conveyor including a retard roller and torque limiters for high performance in sheet separation and reduced conveyance resistance to a sheet, and provide an image forming apparatus including the sheet conveyor.

According to an aspect of the disclosure, a sheet conveyor includes a separation roller, a retard roller forming a nip with the separation roller, and a load application device configured to apply a load to the retard roller. The load application device includes a motor, and a first drive train, a second torque limiter, and a controller. The first drive train includes a plurality of gears for transmitting a driving force from the motor to the retard roller, a first torque limiter configured to communicate with one of the plurality of gears, and a clutch disposed between the motor and the first torque limiter. The second torque limiter is isolated from the first drive train and configured to communicate with the retard roller. The controller is configured to, during conveyance of a sheet, control the clutch to allow transmission of the driving force from the motor for a predetermined time period and to interrupt transmission of the driving force from the motor after expiration of the predetermined time period.

According to another aspect of the disclosure, an image forming apparatus includes an image forming unit configured to form an image onto a sheet and the sheet conveyor.

During conveyance of a sheet, the clutch is controlled to allow transmission of the driving force form the motor for a predetermined time period, and thus the retard roller may be subjected to loads from both the first torque limiter and the second torque limiter. When the clutch is controlled to interrupt transmission of the driving force from the motor after expiration of the predetermined time period, the retard roller may become free from a load of the first torque limiter and is subjected to only a load of the second torque limiter, thereby reducing a conveyance resistance to a sheet. Such load elimination may enable reduction of the load on the motor, thereby achieving power savings of the sheet conveyor.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
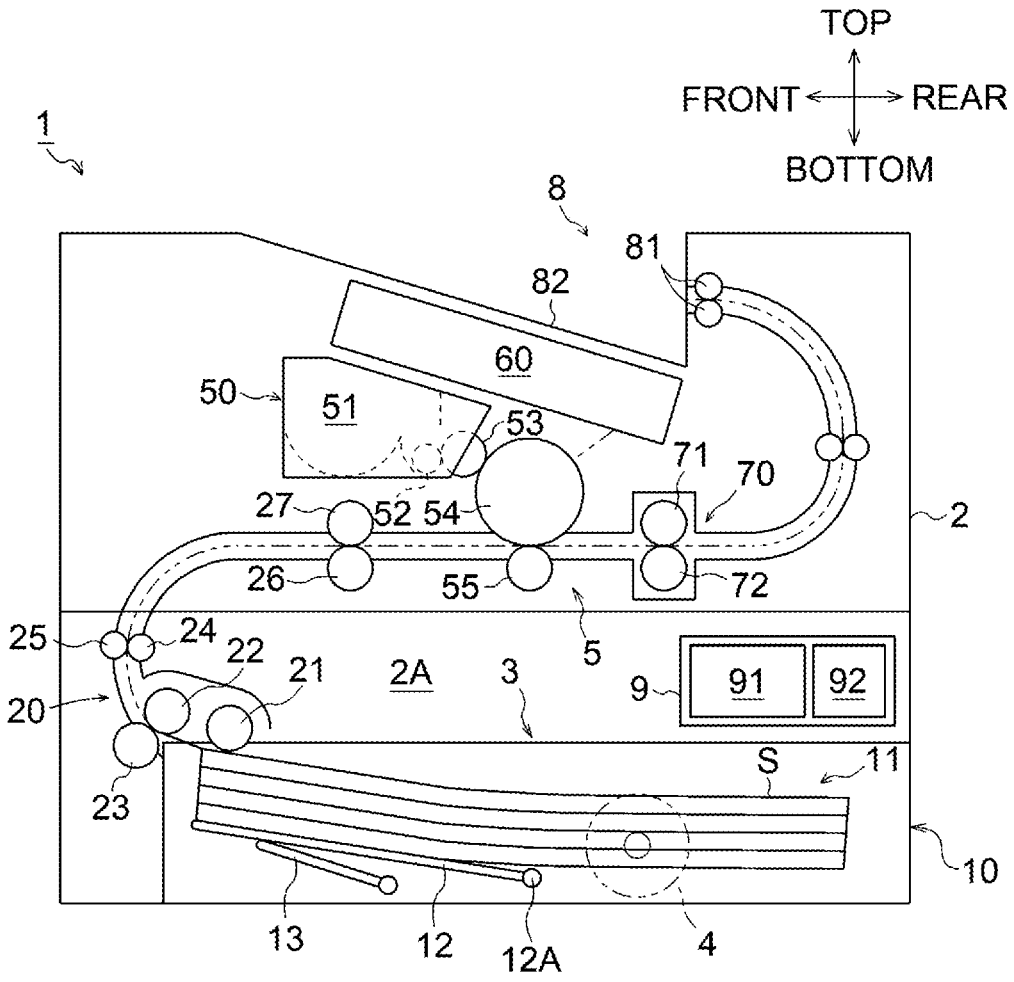
FIG. 1 is a cross-sectional view of an image forming apparatus in an illustrative embodiment according to one or more aspects of the disclosure.
Figure 2:
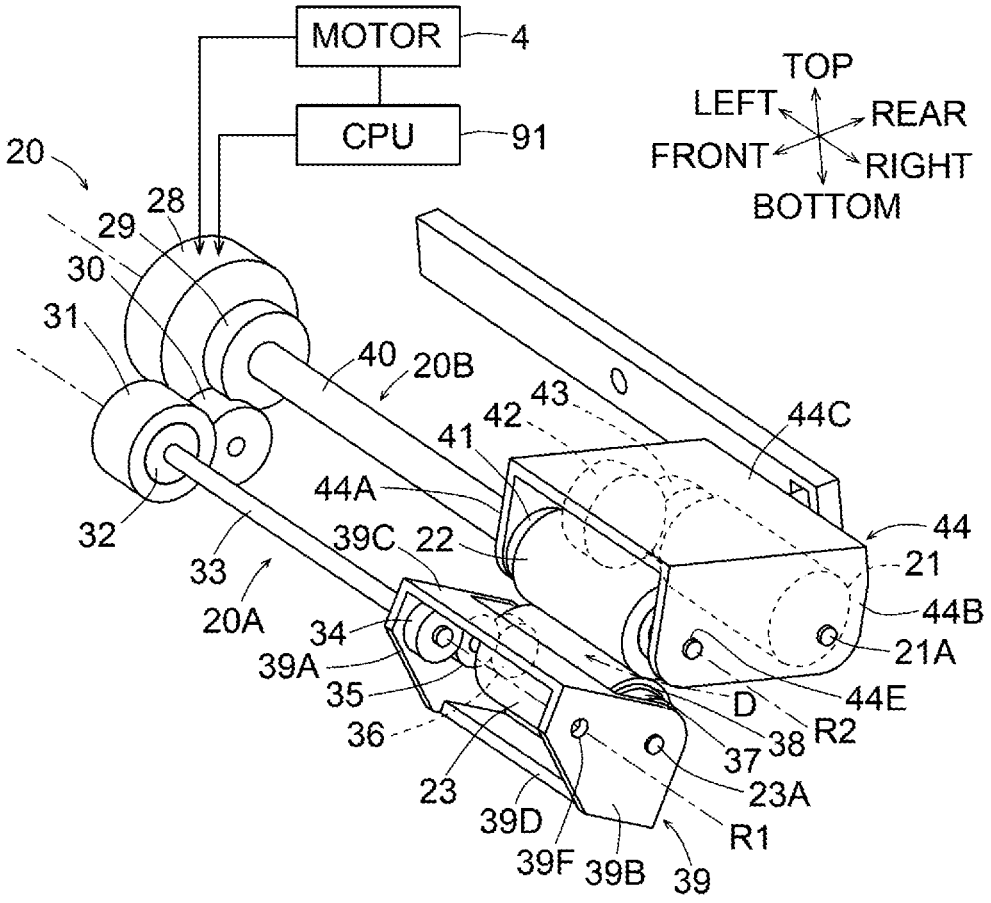
FIG. 2 is a perspective view of a feed mechanism in the illustrative embodiment according to one or more aspects of the disclosure.

In the following description, directions are defined with reference to an orientation of an image forming apparatus 1 that may be disposed in an orientation in which it may be intended to be used as illustrated in FIGS. 1 and 2. A direction toward which a sheet tray 10 is drawn from the image forming apparatus 1 may be defined as the front, and the opposite direction may be defined as the rear. A right-left direction may be defined with respect to the image forming apparatus 1 as viewed from the front of the image forming apparatus 1. A side of the image forming apparatus 1, in which a discharge tray 82 may be provided, may be defined as the top of the image forming apparatus 1, and the opposite side may be defined as the bottom.

Overall Configuration of Image Forming Apparatus

As illustrated in FIG. 1, the image forming apparatus 1 includes a housing 2, a feed unit 3, a motor 4, an image forming unit 5, a discharge unit 8, and a controller 9. Examples of image forming apparatuses include the image forming apparatus 1. Examples of image forming units include the image forming unit 5.

The feed unit 3 is disposed at a lower portion of the image forming apparatus 1. The feed unit 3 is configured to store one or more sheets S and feed the one or more sheets S one by one to the image forming unit 5. The image forming unit 5 is disposed downstream from the feed unit 3 in a direction in which a sheet S is conveyed in the image forming apparatus 1 (hereinafter, referred to as the "conveyance direction". The image forming unit 5 is configured to form an image onto a sheet S fed by the feed unit 3. The discharge unit 8 is disposed downstream from the image forming unit 5 in the conveyance direction. The discharge unit 8 is configured to discharge a sheet S having an image formed by the image forming unit 5, to the outside of the image forming apparatus 1.

The feed unit 3 includes the sheet tray 10, a feed mechanism 20, a conveying roller 24, and a registration roller 26. Examples of constituents of a sheet conveyor include the feed mechanism 20.

The image forming apparatus 1 further includes a tray attachment portion 2A at a lower portion of the housing 2. The sheet tray 10 is detachably attachable to the tray attachment portion 2A. The sheet tray 10 is movable relative to the tray attachment portion 2A. More specifically, for example, for attaching the sheet tray 10 to the tray attachment portion 2A, the sheet tray 10 is moved into the image forming apparatus 1 from the front toward the rear of the image forming apparatus 1 relative to the tray attachment portion 2A. The sheet tray 10 may be thus positioned at an attached position. For pulling out the sheet tray 10, the sheet tray 10 is moved toward the front from the attached position relative to the tray attachment portion 2A. The sheet tray 10 may be thus positioned at an exposed position.

The sheet tray 10 includes a tray body 11, a support plate 12, and a raising member 13. The tray body 11 is configured to support one or more sheets S. The support plate 12 is disposed at the tray body 11. The support plate 12 is configured to support the one or more sheets S and change the position of the one or more sheets S in a top-bottom direction. The raising member 13 is configured to raise the support plate 12.

The support plate 12 is supported by a pivot 12A. The support plate 12 is configured to pivot in the top-bottom direction about the pivot 12A. The raising member 13 is configured to be driven by the motor 4 such that its distal end moves upward. The upward movement of the distal end of the raising member 13 raises the support plate 12 to move the one or more sheets S supported by the support plate 12, upward to a feedable position (refer to FIG. 1).

The feed mechanism 20 is configured to separate a single sheet S from the remainder placed in the sheet tray 10 and feed the separated sheet S toward the conveying roller 24. The feed mechanism 20 includes a feed roller 21, a separation roller 22, and a retard roller 23.

The feed roller 21 is disposed above the support plate 12. The feed roller 21 is configured to feed, in a feed direction D (refer to FIG. 2), one or more of the one or more sheets S positioned at the feedable position by the support plate 12. The feed direction D may refer to a direction in which one or more sheets S are fed from the sheet tray 10. The separation roller 22 is disposed downstream from the feed roller 21 in the conveyance direction. The retard roller 23 faces the separation roller 22. The retard roller 23 is urged toward the separation roller 22 to form a nip with the separation roller 22.

The feed roller 21 is configured to feed one or more sheets S toward the separation roller 22. In a case where the feed roller 21 feeds two or more sheets S, the separation roller 22 and the retard roller 23 separate a single sheet S from the fed sheets S and convey the separated sheet S toward the conveying roller 24. In a case where the feed roller 21 feeds a single sheet S, the separation roller 22 and the retard roller 23 convey the fed sheet S toward the conveying roller 24.

The conveying roller 24 is configured to apply a conveying force to a sheet S. The conveying roller 24 is disposed downstream from the feed mechanism 20 in the conveyance direction. The conveying roller 24 is disposed facing a cleaning roller 25 for removing paper dust from a sheet S. The conveying roller 24 and the cleaning roller 25 are configured to pinch a sheet S fed from the feed mechanism 20 and further convey the sheet S toward the registration roller 26.

The registration roller 26 is disposed downstream from the conveying roller 24 in the conveyance direction. The registration roller 26 is disposed facing another registration roller 27. The registration roller 26 is configured to pinch and convey a sheet S with the registration roller 27. The registration roller 26 is further configured to temporarily stop conveyance of a sheet S by restricting further movement of the leading edge of the sheet S, and restart conveyance of the sheet S toward a transfer position at a predetermined timing.

The image forming unit 5 includes a process cartridge 50, an exposure device 60, and a fixing device 70. The process cartridge 50 is configured to transfer an image onto a sheet S fed from the feed unit 3. The exposure device 60 is configured to expose a circumferential surface of a photosensitive drum 54 of the process cartridge 50. The fixing device 70 is configured to fix an image transferred onto a sheet S by the process cartridge 50.

The process cartridge 50 is disposed above the tray attachment portion 2A in the housing 2. The process cartridge 50 includes a developer chamber 51, a supply roller 52, a developing roller 52, the photosensitive drum 54, and a transfer roller 55.

The developer chamber 51 stores developer (e.g., toner) therein. The process cartridge 50 further includes an agitator. The agitator is configured to agitate toner to supply toner onto a circumferential surface of the supply roller 52. The supply roller 52 is configured to further supply toner onto a circumferential surface of the developing roller 53.

The developing roller 53 is in intimate contact with the supply roller 52. The developing roller 53 is configured to carry toner supplied by the supply roller 52. The toner carried by the developing roller 53 may be positively charged by a contact member that may be slidable relative to the developing roller 53. The developing roller 53 is configured to receive a positive developing bias applied by a bias application device.

The photosensitive drum 54 is disposed adjacent to the developing roller 53. A circumferential surface of the photosensitive drum 54 may be uniformly and positively charged by a charger and then exposed by the exposure device 60. Such exposure may cause a portion of the circumferential surface of the photosensitive drum 54 to have lower potential than the other portion of the photosensitive drum 54, thereby forming an electrostatic latent image based on image data on the circumferential surface of the photosensitive drum 54. Thereafter, the developing roller 53 supplies the positively charged toner onto the circumferential surface of the photosensitive drum 54 to visualize the electrostatic latent image, thereby forming a developer image on the circumferential surface of the photosensitive drum 54.

The transfer roller 55 is disposed facing the photosensitive drum 54. The transfer roller 55 is configured to receive a negative transfer bias applied by the bias application device. In a state where the circumferential surface of the transfer roller 55 is being subjected to a transfer bias, the transfer roller 55 and the photosensitive drum 54 having a developer image pinch a sheet S therebetween (e.g., at the transfer position) and convey the sheet S forward, thereby transferring the developer image onto the sheet S from the circumferential surface of the photosensitive drum 54.

The exposure device 60 includes a laser diode, a polygon mirror, and reflectors. The exposure device 60 is configured to expose the circumferential surface of the photosensitive drum 54 by emitting a laser beam toward the circumferential surface of the photosensitive drum 54 based on image data inputted to the image forming apparatus 1.

The fixing device 70 includes a heat roller 71 and a pressure roller 72. The heat roller 71 is configured to rotate by a driving force from the motor 4. The heat roller 71 is further configured to heat by application of power from a power supply. The pressure roller 72 is disposed facing the heat roller 71. The pressure roller 72 is in intimate contact with the heat roller 71. The pressure roller 72 is configured to rotate with the rotation of the heat roller 71. In response to a sheet S having a transferred developer image reaching the fixing device 70, the heat roller 71 and the pressure roller 72 pinch and convey the sheet S to fix the developer image onto the sheet S.

The discharge unit 8 includes a discharge roller pair 81 and a discharge tray 82. The discharge roller pair 81 is configured to discharge, to the outside of the housing 2, a sheet S that has passed the fixing device 70. The discharge tray 82 is defined at a top of the housing 2. The discharge tray 82 is configured to support one or more sheets S discharged to the outside of the housing 2 by the discharge roller pair 81.

The controller 9 is configured to control overall operation of the image forming apparatus 1. The controller 9 includes a CPU (central processing unit) 91 and a memory 92. The CPU 91 may function as a controller. The memory 92 is configured to store detection results of a sheet sensor. The CPU 91 is configured to control the motor 4, the feed mechanism 20, and the image forming unit 5 in accordance with one or more programs stored in a ROM (read-only memory). For example, the CPU 91 controls, during conveyance of a sheet S, a clutch 28 of the feed mechanism 20 to engage or allow transmission of a driving force from the motor 4 for a predetermined time period and to disengage or interrupt transmission of the driving force from the motor 4 after expiration of the predetermined time period.

Configuration of Feed Mechanism

Figure 3:
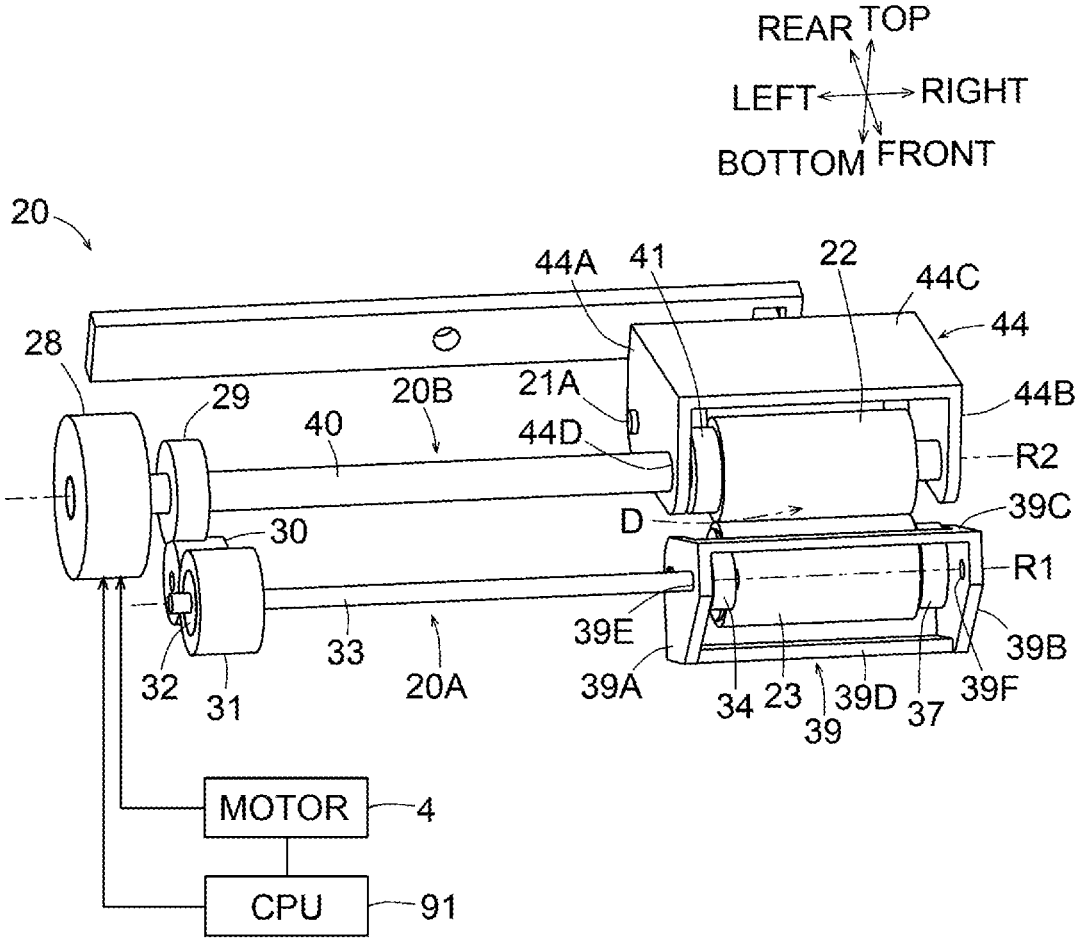
FIG. 3 is another perspective view of the feed mechanism in the illustrative embodiment according to one or more aspects of the disclosure.
Figure 4:
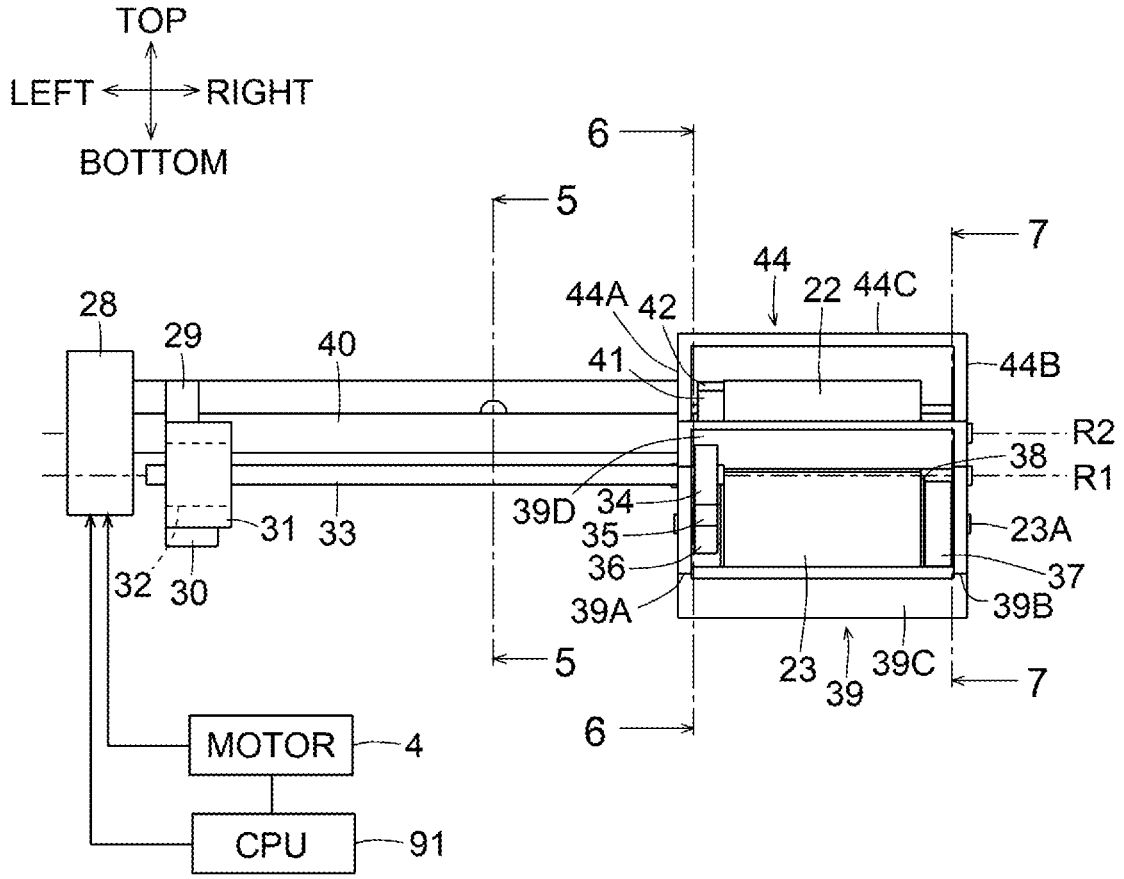
FIG. 4 is a front view of the feed mechanism in the illustrative embodiment according to one or more aspects of the disclosure.

Referring to FIGS. 2 and 3, configuration of the feed mechanism 20 will be described. The feed mechanism 20 includes the clutch 28, a first gear 29, a second gear 30, a third gear 31, a first torque limiter 32, and a first shaft 33 as well as the feed roller 21, the separation roller 22, and the retard roller 23. The feed mechanism 20 further includes a fourth gear 34, a fifth gear 35, a sixth gear 36, a second torque limiter 37, a one-way clutch 38, and a first holder 39. The feed mechanism 20 further includes a second shaft 40, a seventh gear 41, an eighth gear 42, a ninth gear 43, and a second holder 44.

The clutch 28, the second shaft 40, the first gear 29, the second gear 30, the third gear 31, the first torque limiter 32, the first shaft 33, the fourth gear 34, the fifth gear 35, and the sixth gear 36 may constitute a first drive train 20A. The constituents of the first drive train 20A are not limited to such specific examples. The first drive train 20A includes a plurality of such gears for transmitting a driving force from the motor 4 to the retard roller 23. More specifically, the first drive train 20A transmits a driving force from the motor 4 to the retard roller 23 such that the retard roller 23 rotates in a direction (e.g., a direction of an arrow F11 (refer to FIG. 8)) opposite to a direction (e.g., a direction of an arrow F6 (refer to FIG. 6)) in which the retard roller 23 conveys a sheet S in the feed direction D.

The clutch 28, the second shaft 40, the first gear 29, the seventh gear 41, the eighth gear 42, and the ninth gear 43 may constitute a second drive train 20B. The constituents of the second drive train 20B are not limited to such specific examples. The second drive train 20B includes a plurality of such gears for transmitting a driving force from the motor 4 to the feed roller 21. More specifically, the second drive train 20B transmits a driving force from the motor 4 to the feed roller 21 such that the feed roller 21 rotates in the direction in which the feed roller 21 conveys a sheet S in the feed direction D.

The motor 4, the first drive train 20A, the first torque limiter 32, the clutch 28, the second torque limiter 37, and the CPU 91 may constitute a load application device. The constituents of the load application device are not limited to such specific examples. The load application device is configured to apply a load to the retard roller 23. More specifically, the load application device is configured to apply a load to the retard roller 23 such that the retard roller 23 rotates in the direction (e.g., in the direction of the arrow F11) opposite to the direction (e.g., a direction of an arrow F6 (refer to FIG. 6)) in which the retard roller 23 conveys a sheet S in the feed direction D.

The clutch 28 may be an electromagnetic clutch. The clutch 28 is configured to selectively allow and interrupt transmission of a driving force from the motor 4. The clutch 28 is connected to the motor 4 via a drive train including a plurality of gears. The clutch 28 is electrically connected to the CPU 91. The clutch 28 is located between the motor 4 and the first torque limiter 32. The clutch 28 is configured to communicate with at least one of the gears included in the second drive train 20B. More specifically, the clutch 28 is located, on a route for transmitting a driving force from the motor 4 to the retard roller 23 (hereinafter, referred to as the "driving force transmission route"), upstream from the first torque limiter 32 in the first drive train 20A and upstream from the first gear 29 in the second drive train 20B.

In the illustrative embodiment, the clutch 28 is disposed at a left end of the second shaft 40 and upstream from the first gear 29 on the driving force transmission route. Engagement of the clutch 28 by control of the CPU 28 allows transmission of a driving force from the motor 4 to the second shaft 40, thereby causing the second shaft 40 and the first gear 29 to rotate. Disengagement of the clutch 28 by control of the CPU 91 interrupts transmission of the driving force from the motor 4 to the second shaft 40.

The first gear 29 is disposed to the right of the clutch 28 and on the second shaft 40. The first gear 29 is configured to rotate together with the second shaft 40. The second gear 30 is in mesh with the first gear 29. The third gear 31 is disposed surrounding an outer circumference of the first torque limiter 32. The third gear 31 is in mesh with the second gear 30.

The first torque limiter 32 is configured to communicate with one of the gears included in the first drive train 20A. In the illustrative embodiment, the first torque limiter 32 is disposed in a space defined by an internal circumference of the third gear 31. The first torque limiter 32 is disposed on the left end portion of the first shaft 33. The first torque limiter 32 is configured to generate a first load. As the third gear 31 rotates by a driving force transmitted from the motor 4, the first torque limiter 32 rotates in the same direction as the direction in which the third gear 31 rotates. The first torque limiter 32 may thus apply, at the maximum, the first load to the first shaft 33 in the same direction as the direction in which the third gear 31 rotates.

The first shaft 33 is configured to rotate on a first axis R1 extending in the right-left direction. The first shaft 33 includes the left end portion on which the first torque limiter 32 is disposed, and a right end portion on which the fourth gear 34 is disposed. The first shaft 33 passes through a through hole 39E defined in a left wall 39A of the first holder 39. That is, the first shaft 33 has a portion that is located inside the first holder 39, and such a portion may be referred to as a covered portion. Such a configuration thus enables the first shaft 33 to support the first holder 39 so as to be swingable on the first axis R1.

The fourth gear 34 is disposed on the right end portion of the first shaft 33. The right end portion of the first shaft 33 is included in the covered portion of the first shaft 33. That is, the fourth gear 34 is disposed in the first holder 39 and to the right of the left wall 39A of the first holder 39. The fourth gear 34 is configured to rotate together with the first shaft 33. The fifth gear 35 is disposed in the first holder 39 and to the right of the left wall 39A of the first holder 39. The fifth gear 35 is in mesh with the fourth gear 34. The sixth gear 36 is disposed in the first holder 39 and to the right of the left wall 39A of the first holder 39. The sixth gear 36 is in mesh with the fifth gear 35. The sixth gear 36 is disposed on a shaft 23A of the retard roller 23. The sixth gear 36 is configured to rotate together with the retard roller 23.

The shaft 23A of the retard roller 23 extends in the right-left direction. The shaft 23A includes a left end portion on which the sixth gear 36 is disposed. The left end portion of the shaft 23A is rotatably supported by the left wall 39A of the first holder 39. The shaft 23A further includes a right end portion that is rotatably supported by the right wall 39B of the first holder 39. That is, the retard roller 23 is rotatably supported by the first holder 39.

The second torque limiter 37 is isolated from the first drive train 20A and configured to communicate with the retard roller 23. In the illustrative embodiment, the second torque limiter 37 is disposed adjacent to the retard roller 23. The second torque limiter 37 is configured to apply a second load to the retard roller 23. The second torque limiter 37 is disposed on an axis of the retard roller 23. The second torque limiter 37 is disposed on a right surface of the one-way clutch 38. The second torque limiter 37 is disposed between the right surface of the one-way clutch 38 and the right wall 39B of the first holder 39. The second torque limiter 37 is fixed to the right wall 39B of the first holder 39.

The one-way clutch 38 is disposed between the retard roller 23 and the second torque limiter 37. In the illustrative embodiment, the one-way clutch 38 is built in the retard roller 23.

The one-way clutch 38 is configured to allow the retard roller 23 to rotate. More specifically, the one-way clutch 38 allows the retard roller 23 to rotate in the direction (e.g., the direction of the arrow F11 (refer to FIG. 8)) opposite to the direction (e.g., the direction of the arrow F6 (refer to FIG. 6)) in which the retard roller 23 conveys a sheet S in the feed direction D. That is, in a case where the retard roller 23 rotates in the direction of the arrow F11, the one-way clutch 38 interrupts transmission of the rotating force of the retard roller 23 to the second torque limiter 37. Thus, the second torque limiter 37 might not generate a second load. Consequently, the retard roller 23 is free from the second load. In a case where the retard roller 23 rotates in the direction of the arrow F6, the one-way clutch 38 allows transmission of the rotating force of the retard roller 23 to the second torque limiter 37. The second torque limiter 37 thus generates and applies a second load to the retard roller 23.

The first holder 39 holds the retard roller 23 to be swingable relative to the separation roller 22. The first holder 39 is used for connecting the second torque limiter 37 thereto. The first holder 39 includes the left wall 39A, the right wall 39B, an upper wall 39C, and a lower wall 39D. The left wall 39A is disposed to the left of the retard roller 23. The right wall 39B is disposed to the right of the second torque limiter 37. The upper wall 39C connects between an upper end of the left wall 39A and an upper end of the right wall 39B. The lower wall 39D connects between a lower end of the left wall 39A and a lower end of the right wall 39B.

The first holder 39 has the through hole 39E at an intersection of the first axis R1 and the left wall 39A. The through hole 39E receives the first shaft 33. The first holder 39 has another through hole 39F at an intersection of the first axis R1 and the right wall 39B. The through hole 39F receives a protrusion of the sheet tray 10. Such a configuration thus enables the first holder 39 to be supported swingably on the first axis R1. In the illustrative embodiment, the retard roller 23 is attached to the sheet tray 10 via the first holder 39. Such a configuration may enable the retard roller 23 to be swingable more simply than a configuration in which the retard roller 23 is attached directly to the sheet tray 10.

The first holder 39 is urged toward the separation roller 22 by an urging member such as a spring. The separation roller 22 and the retard roller 23 thus form a nip therebetween.

The second shaft 40 is configured to rotate on a second axis R2 extending in the right-left direction. The second shaft 40 includes a left end portion on which the clutch 28 and the first gear 29 are disposed, and a right end portion on which the seventh gear 41 and the separation roller 22 are disposed. The second shaft 40 passes through a through hole 44D and a through hole 44E. That is, the second shaft 40 has a portion that is located inside the second holder 44, and such a portion may be referred to as a covered portion. The through hole 44D is defined in a left wall 44A of the second holder 44. The through hole 44E is defined in a right wall 44B of the second holder 44. Such a configuration thus enables the second shaft 40 to support the second holder 44 so as to be swingable on the second axis R2.

The seventh gear 41 is disposed on the covered portion of the first shaft 40 and to the right of the left wall 44A of the second holder 44. The seventh gear 41 is configured to rotate together with the second shaft 40.

The separation roller 22 includes a one-way clutch built therein. Such a configuration enables, when the second shaft 40 is at a standstill, the separation roller 22 to rotate idly relative to the second shaft 40 in a direction in which the separation roller 22 conveys a sheet S in the feed direction D. When the second shaft 40 rotates in a direction of an arrow F1 (FIG. 5), the second roller 40 transmits its driving force to the separation roller 22 to rotate the separation roller 22 in the same direction as the direction of the arrow F1.

The eighth gear 42 is disposed in the second holder 44 and to the right of the left wall 44A of the second holder 44. The eighth gear 42 is in mesh with the seventh gear 41. The ninth gear 43 is disposed in the second holder 44 and to the right of the left wall 44A of the second holder 44. The ninth gear 43 is in mesh with the eighth gear 42. The ninth gear 43 is disposed on a shaft 21A of the feed roller 21.

The shaft 21A of the feed roller 21 extends in the right-left direction. The shaft 21A includes a left end portion on which the ninth gear 43 is disposed. The left end portion of the shaft 21A is rotatably supported by the left wall 44A of the second holder 44. The shaft 21 A further includes a right end portion that is rotatably supported by the right wall 44B of the second holder 44. That is, the feed roller 21 is rotatably supported by the second holder 44.

The feed roller 21 includes a one-way clutch built therein. Such a configuration enables, when the shaft 21A is at a standstill, the feed roller 21 to rotate idly relative to the shaft 21A in a direction in which the separation roller 22 conveys a sheet S in the feed direction D. As the ninth gear 43 rotates, the shaft 21A rotates and the one-way clutch allows transmission of a rotating force of the shaft 21A to the feed roller 21. Thus, the rotating force is transmitted between the feed roller 21 and the ninth gear 43.

The second holder 44 holds the feed roller 21 and the separation roller 22. The second holder 44 enables the feed roller 21 to swing on the second shaft R2 relative to one or more sheets S supported by the sheet tray 10. The second holder 44 includes the left wall 44A, the right wall 44B, and an upper wall 44C. The left wall 44A is disposed to the left of the feed roller 21 and the separation roller 22. The right wall 44B is disposed to the right of the feed roller 21 and the separation roller 22. The upper wall 39C connects between an upper end of the left wall 44A and an upper end of the right wall 44B.

The second holder 44 has the through hole 44D at an intersection of the second axis R2 and the left wall 44A. The through hole 44D receives the second shaft 40. The second holder 44 has the through hole 44E at an intersection of the second axis R2 and the right wall 44B. The through hole 44E receives the second shaft 40. Such a configuration thus enables the second holder 44 to be supported swingably on the second axis R2. The second holder 44 is urged, by an urging member such as a spring, toward one or more sheets S supported by the sheet tray 10. The feed roller 21 is thus pressed against a topmost sheet S of the one or more sheets S supported by the sheet tray 10.

According to the illustrative embodiment, a single motor (e.g., the motor 4) may be commonly used for driving the retard roller 23, the separation roller 22, and the feed roller 21 in the feed mechanism 20. More specifically, a driving force of the motor 4 may be inputted to the retard roller 23 via the first drive train 20A and also inputted to the separation roller 22 and the feed roller 21 via the second drive train 20B. Such a configuration may enable reduction of parts count, thereby reducing cost of the image forming apparatus 1.

The feed mechanism 20 includes a single clutch (e.g., the clutch 28) that may be commonly used between the first drive train 20A and the second drive train 20B. Such a configuration may enable further reduction of the parts count, thereby further reducing cost of the image forming apparatus 1.

In the feed mechanism 20, the first torque limiter 32, the retard roller 23, and the second torque limiter 37 are positioned in this order from the left along the direction in which the first axis R1 extends. Such an arrangement may enable the second torque limiter 37 to be isolated from the first drive train 20A.

Operations of Feed Mechanism

Hereinafter, a description will be provided on operations performed by the feed mechanism 20 during conveyance of a sheet S. The operations include, for example, a feed and separation operation and a conveying operation. More specifically, for example, the feed and separation operation includes a series of operations starting from a start of feeding of one or more sheets S from the sheet tray 10 and ending with separation of a leading edge of a single sheet S from the fed one or more sheets S. The conveying operation includes a series of operations starting subsequent to the feed and separation and ending with completion of passage of a trailing edge of the sheet S through the retard roller 23.

Feed and Separation Operation

Referring to FIGS. 5 to 8, the feed and separation operation will be described.

Figure 5:
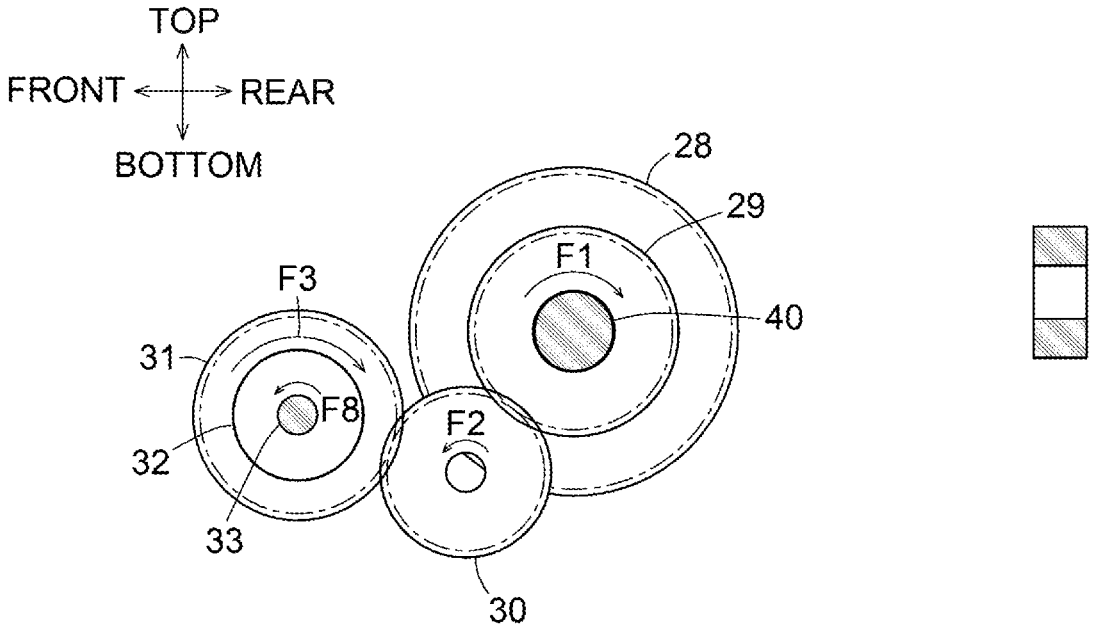
FIG. 5 is a sectional view taken in a direction of arrows 5-5 as shown in FIG. 4 in the illustrative embodiment according to one or more aspects of the disclosure.

The feed and separation operation may be implemented by control of the CPU 91. More specifically, for example, the CPU 91 controls the clutch 28 to engage for a predetermined time period to execute the feed and separation operation. In response to engagement of the clutch 28, the clutch 28 allows transmission of a driving force from the motor 4 to the second shaft 40. As illustrated in FIG. 5, the second shaft 40 thus rotates in the direction of the arrow F1. The rotation of the second shaft 40 in the direction of the arrow F1 causes the first gear 29 to rotate in the direction of the arrow F1, the second gear 30 to rotate in a direction of an arrow F2, and the third gear 31 to rotate in a direction of an arrow F3.

Figure 6:
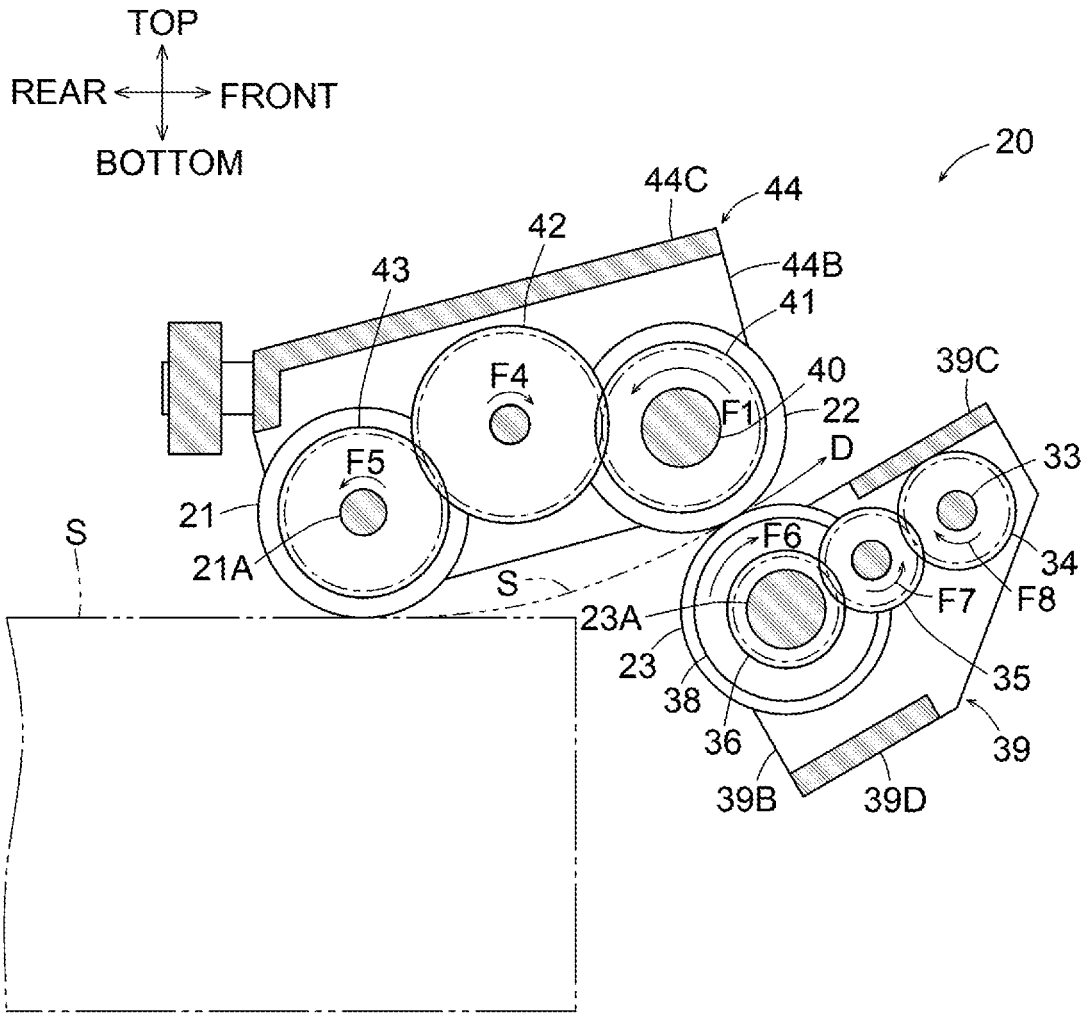
FIG. 6 is a sectional view taken in a direction of arrows 6-6 as shown in FIG. 4 in the illustrative embodiment according to one or more aspects of the disclosure.
Figure 7:
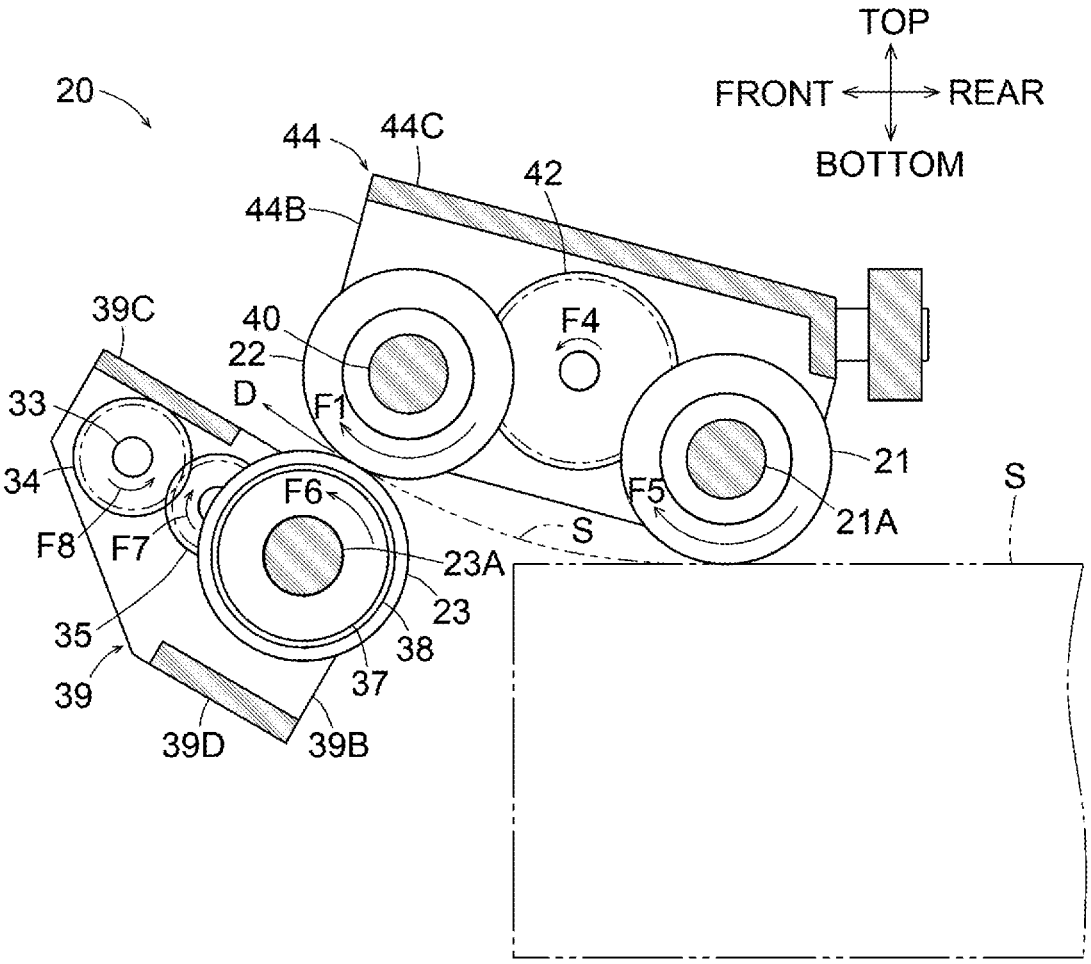
FIG. 7 is a sectional view taken in a direction of arrows 7-7 as shown in FIG. 4 in the illustrative embodiment according to one or more aspects of the disclosure.

As illustrated in FIG. 6, the rotation of the second shaft 40 in the direction of the arrow F1 further causes the separation roller 22 and the seventh gear 41 to rotate in the direction of the arrow F1. The rotation of the separation roller 22 in the direction of the arrow F1 may act as a conveying force for conveying a sheet S in the feed direction D. The rotation of the seventh gear 41 in the direction of the arrow F1 causes the eighth gear 42 to rotate in a direction of an arrow F4 and the ninth gear 43 and the feed roller 21 to rotate in a direction of an arrow F5. The rotation of the feed roller 21 in the direction of the arrow F5 may act as a conveying force for conveying a sheet S in the feed direction D.

The rotation of the separation roller 22 in the direction of the arrow F 1 causes the retard roller 23 forming the nip with the separation roller 22 to rotate in the direction of the arrow F6. At that time, the one-way clutch 38 allows transmission of the rotating force of the retard roller 23 rotating in the direction of the arrow F6, to the second torque limiter 37. The second torque limiter 37 thus generates and applies a second load to the retard roller 23.

The rotation of the retard roller 23 in the direction of the arrow F6 causes the sixth gear 36 to rotate in the direction of the arrow F6, the fifth gear 35 to rotate in a direction of an arrow F7, and the fourth gear 34 and the first shaft 33 to rotate in a direction of an arrow F8. The rotating direction (e.g., the direction of the arrow F8) of the first shaft 33 is opposite to the rotation direction (e.g., the direction of the arrow F3) of the third gear 31. The first torque limiter 32 thus generates a first load.

The first load generated by the first torque limiter 32 is transmitted to the retard roller 23 via the first shaft 33, the fourth gear 34, the fifth gear 35, and the sixth gear 36. The separation roller 22 thus rotates the retard roller 23 in the direction in which the retard roller 23 conveys a sheet S in the feed direction D, with a load that may be a combination of the first load and the second load. Accordingly, the same combined load may be also applied to the motor 4.

In such a state, the feed roller 21 feeds one or more sheets S in the feed direction D from the sheet tray 10. In a case where the feed roller 21 feeds a single sheet S, the separation roller 22 and the retard roller 23 nip the sheet S therebetween and normally convey the sheet S in the feed direction D. In a case where the feed roller 21 feeds a plurality of, for example, two, sheets S at a time (hereinafter, such a situation may also be referred to as "multiple sheet feeding"), the separation roller 22 and the retard roller 23 nip the both sheets S therebetween with leading edge portions of the sheets S overlapping each other.

Figure 8:
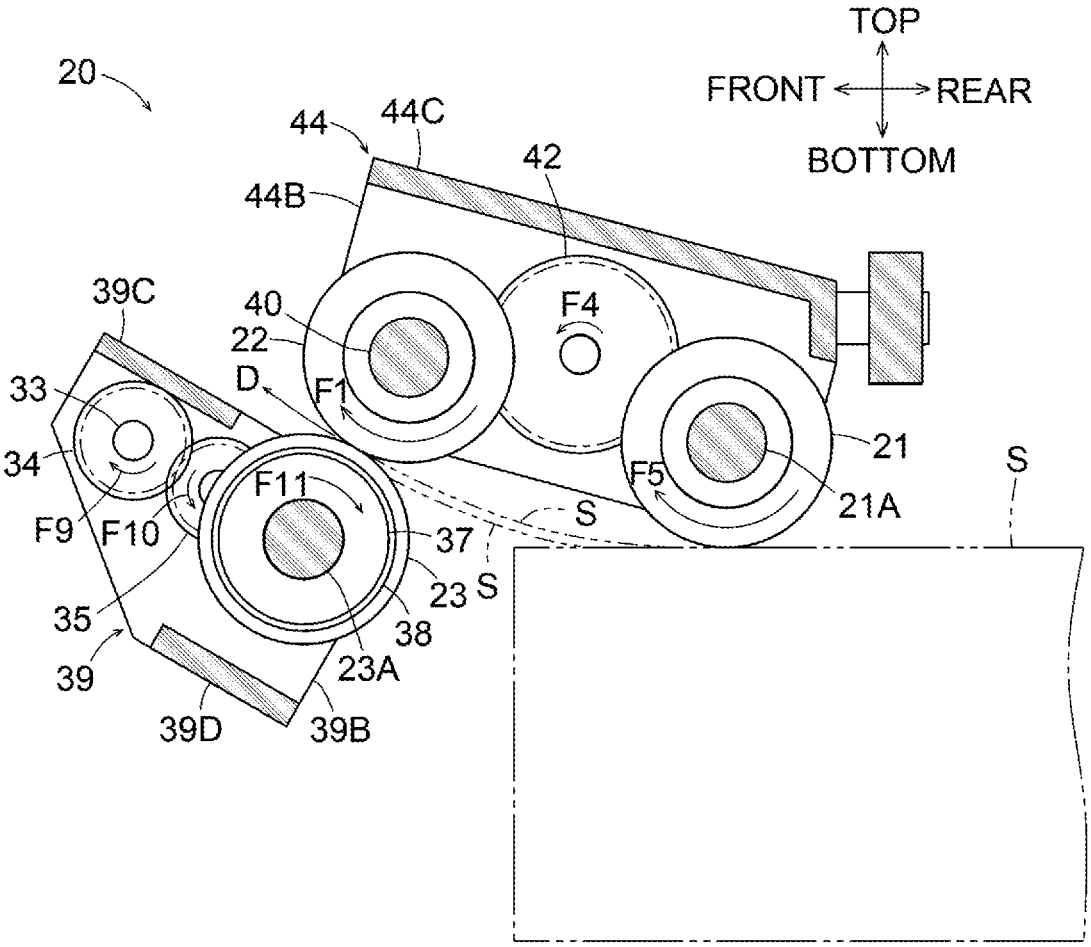
FIG. 8 is a sectional view taken in the direction of arrows 7-7 as shown in FIG. 4 in the illustrative embodiment according to one or more aspects of the disclosure.

As illustrated in FIG. 8, in a state where the separating roller 22 and the retard roller 23 nip the both sheets S, a frictional force acting between the two sheets S may be smaller than a frictional force acting between the upper sheet S and the separation roller 22, and may also be smaller than a frictional force acting between the lower sheet S and the retard roller 23. Such difference in frictional force thus causes the upper and lower sheets S to slip relative to each other, thereby hardly transmitting the driving force to the retard roller 23 via the separation roller 22. Consequently, the separation roller 22 rotating in the direction of the arrow F1 by the driving force from the motor 4 conveys only the upper sheet S in the feed direction D.

In a case where the driving force for rotating the retard roller 23 in the direction of the arrow F6 transmitted to the retard roller 32 via the separation roller 22 is smaller than the combined load of the first load generated by the first torque limiter 32 and the second load generated by the second torque limiter 37, the retard roller 23 stops rotating in the direction of the arrow F6. In a case where the driving force for rotating the retard roller 23 in the direction of the arrow F6 transmitted to the retard roller 23 via a sheet S is smaller than the first load generated by the first torque limiter 32, the retard roller 23 receives, via the first drive train 20A, a driving force for rotating in the direction of the arrow F11. The retard roller 23 thus rotates in the direction of the arrow F11 opposite to the direction of the arrow F6.

More specifically, for example, the driving force transmitted from the motor 4 causes the first shaft 33 and the fourth gear 34 to rotate in a direction of an arrow F9, the fifth gear 35 to rotate in a direction of an arrow F10, and the sixth gear 36 to rotate in the direction of the arrow F11. At that time, the one-way clutch 38 rotates in the direction of the arrow F11 and thus the second torque limiter 37 might not generate a second load. Therefore, the retard roller 23 rotates in the direction of the arrow F11 opposite to the direction of the arrow F6 under the first load generated by the first torque limiter 32.

Consequently, the retard roller 23 conveys the lower sheet S in the opposite direction to the feed direction D. The retard roller 23 may thus function as an active roller, thereby improving performance of separating leading edge portions of sheets S. The retard roller 23 functioning as the active roller may have a higher separation performance than the retard roller 23 functioning as a passive roller.

Conveying Operation

Referring to FIGS. 9 to 12, the conveying operation will be described.

The conveying operation may be implemented by control of the CPU 91. More specifically, for example, the CPU 91 controls the clutch 28 to disengage to execute the conveying operation after the feed and separation operation in which the CPU 91 controls the clutch 28 to engage for the predetermined time period. In response to disengagement of the clutch 28, the clutch 28 interrupts the transmission of the driving force to the second shaft 40, that is, to the feed mechanism 20 from the motor 4. The feed mechanism 20 is thus driven by the movement of the sheet S being conveyed by the driving force of the conveyance roller 24.

Figure 9:
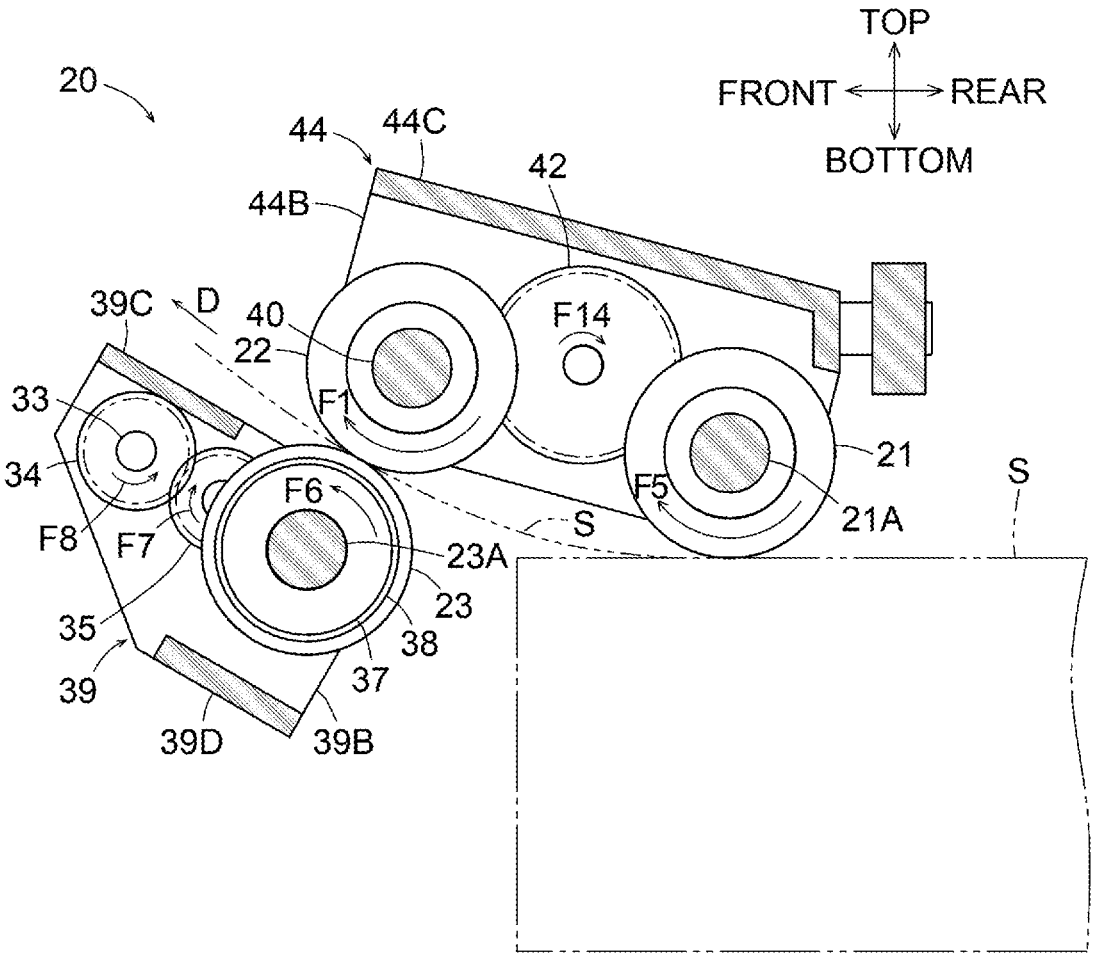
FIG. 9 is a sectional view taken in the direction of arrows 7-7 as shown in FIG. 4 in the illustrative embodiment according to one or more aspects of the disclosure.
Figure 10:
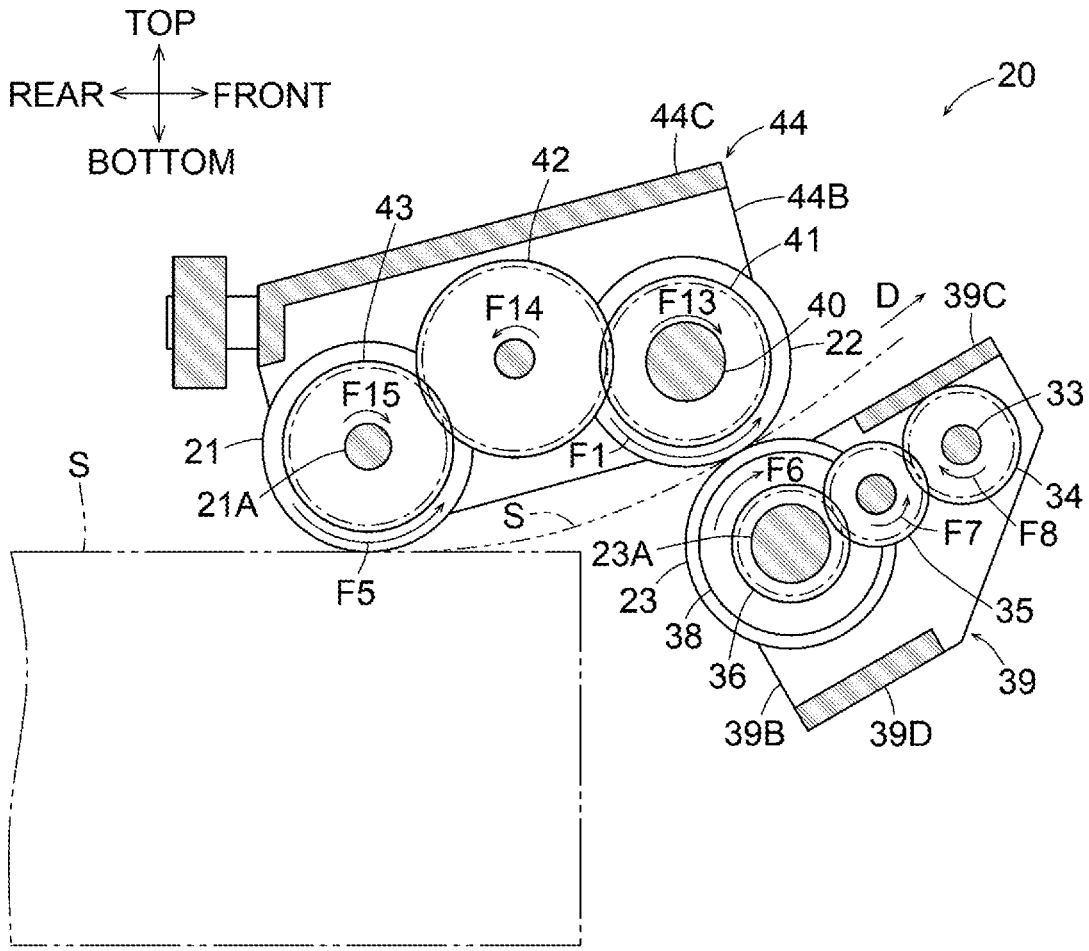
FIG. 10 is a sectional view taken in the direction of arrows 6-6 as shown in FIG. 4 in the illustrative embodiment according to one or more aspects of the disclosure.

That is, as illustrated in FIGS. 9 and 10, the feed roller 21, the separation roller 22, and the retard roller 23 each contacting the sheet S rotate in the respective directions in which the feed roller 21, the separation roller 22, and the retard roller 23 each convey the sheet S in the feed direction D. More specifically, for example, the feed roller 21 rotates in the direction of the arrow F5, the separation roller 22 rotates in the direction of the arrow F1, and the retard roller 23 rotates in the direction of the arrow F6.

The feed roller 21 and the separation roller 22 include the respective one-way clutches built therein. Such a configuration enables the feed roller 21 and the separation roller 22 to rotate idly relative to the shaft 21A and the second shaft 40, respectively. As the retard roller 23 rotates in the direction of the arrow F6, the one-way clutch 38 allows transmission of the rotating force of the retard roller 23 rotating in the direction of the arrow F6, to the second torque limiter 37. The second torque limiter 37 thus generates and applies a second load to the retard roller 23.

Figure 11:
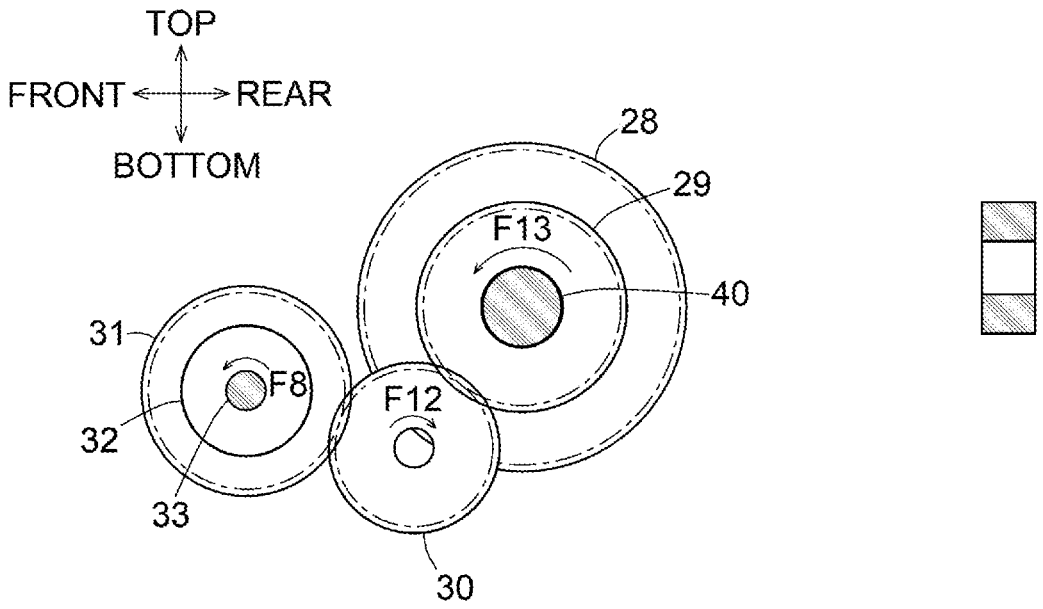
FIG. 11 is a sectional view taken in the direction of arrows 5-5 as shown in FIG. 4 in the illustrative embodiment according to one or more aspects of the disclosure.

The rotation of the retard roller 23 in the direction of the arrow F6 causes the sixth gear 36 to rotate in the direction of the arrow F6, the fifth gear 35 to rotate in the direction of the arrow F7, and the fourth gear 34 and the first shaft 33 to rotate in the direction of the arrow F8. As illustrated in FIG. 11, the rotation of the first shaft 33 in the direction of the arrow F8 causes the first torque limiter 32 and the third gear 31 to rotate in the direction of the arrow F8, the second gear 30 to rotate in the direction of the arrow F12, and the first gear 29 and the second shaft 40 to rotate in a direction of an arrow F13. At that time, no load may be applied to the first torque limiter 32 by the third gear 31. The first torque limiter 32 thus might not generate a first load. Consequently, the first load generated by the first torque limiter 32 might not be applied to the retard roller 23.

The rotation of the second shaft 40 in the direction of the arrow F13 causes the seventh gear 41 to rotate in the direction of the arrow F13, the eighth gear 42 to rotate in a direction of an arrow F14, and the ninth gear 43 to rotate in a direction of an arrow F15. At that time, the one-way clutches of the feed roller 21 and the separation roller 22 interrupt transmission of the rotating force of the second shaft 40 to the separation roller 22 and the rotating force of the ninth gear 43 to the feed roller 21. The feed roller 21 and the separation roller 22 thus continue rotating in the direction of the arrow F5 and in the direction of the arrow F1, respectively.

In response to disengagement of the clutch 28, the retard roller 23 becomes free from the first load. That is, only the second load generated by the second torque limiter 37 is applied to the retard roller 23. Consequently, only the second load is applied to a sheet S being conveyed, thereby reducing a conveyance resistance to the sheet S. In response to disengagement of the clutch 28, the motor 4 becomes free from both the first load and the second load. Such load elimination may enable reduction of the load on the motor 4, thereby achieving power saving of the image forming apparatus 1.

Figure 12:
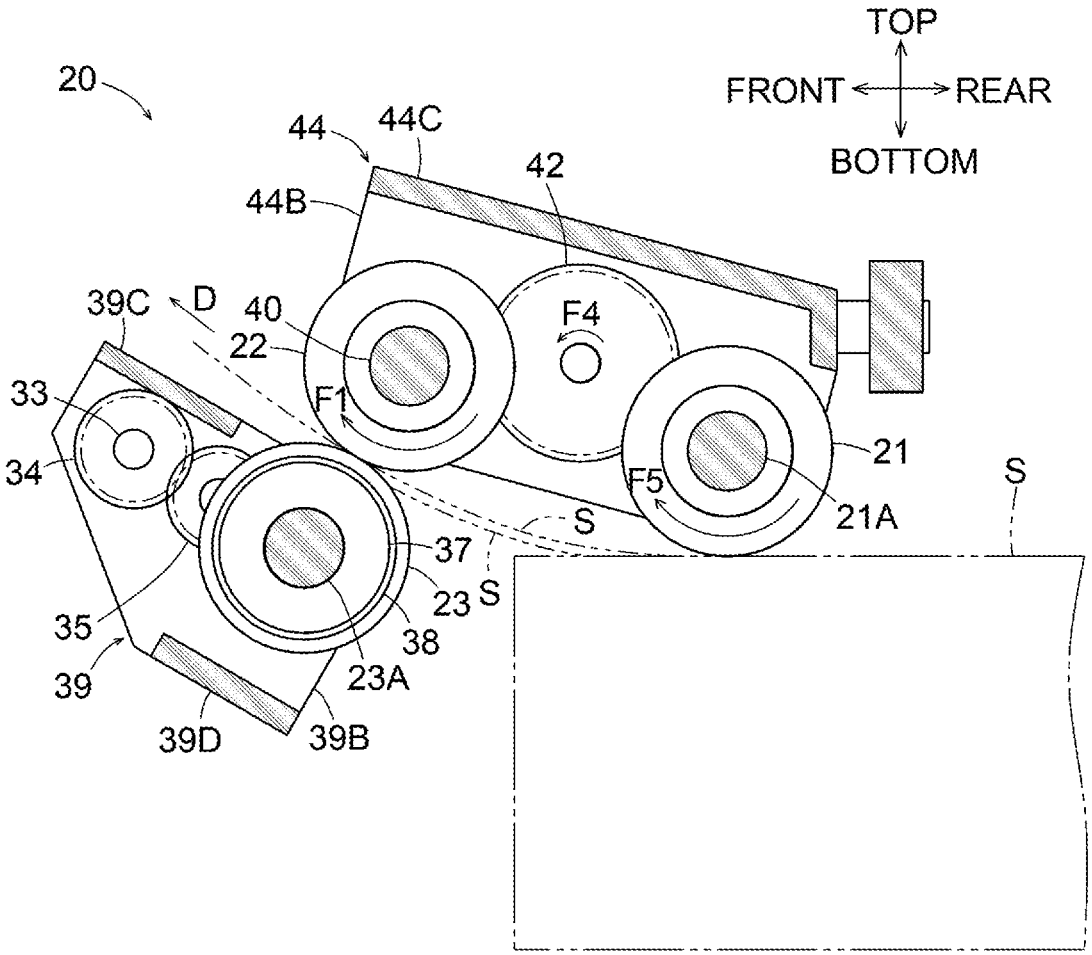
FIG. 12 is a sectional view taken in the direction of arrows 7-7 as shown in FIG. 4 in the illustrative embodiment according to one or more aspects of the disclosure.

In a case where, during sheet conveyance, the feed roller 21 feeds, at a time, a plurality of, for example, two, sheets S including a first sheet S and a second sheet S to be fed subsequent to the first sheet S, as illustrated in FIG. 12, the separation roller 22 and the retard roller 23 nip both the first and second sheets S with a leading edge of the second sheet S overlapping below the first sheet S. In such a state, the conveying roller 24 feeds only the upper (e.g., first) sheet S in the feed direction D.

In this state, frictional force acting between the lower sheet S and the retard roller 23 may be greater than the frictional force acting between the lower sheet S and the upper sheet S. The lower (e.g., second) sheet S may thus slip relative to the upper sheet S. Such relative slippage of the sheets S may hardly allow transmission of the driving force of the conveying roller 24 to the retard roller 23 via the upper sheet S being conveyed. Thus, the driving force transmitted to the retard roller 23 becomes smaller than the second load generated by the second torque limiter 37, and the retard roller 23 stops rotating in the direction of the arrow F6. The clutch 28 is then controlled to disengage to interrupt transmission of the driving force of the motor 4 to the retard roller 23. The retard roller 23 thus stop rotating.

The retard roller 23 therefore blocks further movement of the lower sheet S in the feed direction D. At that time, the retard roller 23 may function as the passive roller, thereby improving performance of separating sheets S if multiple sheet feeding occurs during sheet conveyance.

Alternative Embodiments

In other embodiments, for example, the feed mechanism 20 might not necessarily include the one-way clutch 38 disposed between the retard roller 23 and the torque limiter 38. In such a case, in a case where the first load is greater than the second load, in response to engagement of the clutch 28, the retard roller 23 may function as the active roller similar to the illustrative embodiment. In a case where the first load is smaller than the second load, in response to engagement of the clutch 28, the retard roller 23 may function as the passive roller. In either of the cases, the performance of separating leading edge portions of sheets S may be improved without the one-way clutch 38.

In the illustrative embodiment, the feed mechanism 20 includes the feed roller 21 and the separation roller 22 as separate members. Nevertheless, in other embodiments, for example, the feed roller 21 may be omitted. In such a case, the separation roller 22 may have a larger diameter than the separation roller 22 according to the illustrative embodiment. Such a configuration may enable the separation roller 22 to contact an upper surface of a topmost sheet S of one or more sheets S supported by the sheet tray 10. The separation roller 22 may thus be enabled to feed a sheet S.

What is claimed is:

1. A sheet conveyor comprising:

a separation roller;

a retard roller forming a nip with the separation roller;

a load application device configured to apply a load to the retard roller, the load application device including a motor, a first drive train including a plurality of gears for transmitting a driving force from the motor to the retard roller, a first torque limiter configured to communicate with one of the plurality of gears to generate a first load, and a clutch disposed between the motor and the first torque limiter, the clutch being connected to the motor via a drive train including a plurality of gears, a second torque limiter isolated from the first drive train and configured to communicate with the retard roller to apply a second load to the retard roller, and a controller configured to, during conveyance of a sheet, control the clutch to allow transmission of the driving force from the motor for a predetermined time period and to interrupt transmission of the driving force from the motor after expiration of the predetermined time period; and a one-way clutch disposed between the retard roller and the second torque limiter isolated Iron the first drive train, clutch being configured to allow the retard roller to rotate, wherein, while the clutch allows the transmission of the driving force, the first torque limiter of the first drive train applies the first load to the retard roller, and the second torque limiter isolated from the first drive train applies the second load to the retard roller, and wherein, while the clutch interrupts transmission of the driving force, the retard roller becomes free from the first load and only the second load is applied to the retard roller.

2. The sheet conveyor according to claim 1, wherein the first load of the first torque limiter is greater than the second load of the second torque limiter.

3. The sheet conveyor according to claim 1, further comprising a feed roller disposed upstream of the separation roller and configured to feed one or more sheets toward the separation roller; and a second drive train including a plurality of gears for transmitting a driving force from the motor to the feed roller, wherein at least one of the plurality of gears of the second drive train is also included in the first drive train.

4. The sheet conveyor according to claim 3, wherein the clutch is configured to communicate with the at least one of the plurality of gears of the second drive train.

5. The sheet conveyor according to claim 4, wherein the separation roller is disposed, in the second drive train, downstream of the clutch and upstream of the feed roller.

6. The sheet conveyor according to claim 4, further comprising a second holder holding the separation roller and the feed roller.

7. The sheet conveyor according to claim 1, wherein the first torque limiter, the retard roller, and the second torque limiter are positioned in this order along an axis of the retard roller.

8. The sheet conveyor according to claim 1, further comprising a holder holding the retard roller to be swingable relative to the separation roller, the holder having a first wall and a second wall, and the holder connecting the retard roller and the second torque limiter between the first wall and second wall.

9. The sheet conveyor according to claim 1, wherein, while the clutch allows the transmission of the driving force, the first torque limiter of the first drive train applies the first load to a first side of the retard roller, and the second torque limiter isolated from the first drive train applies the second load to a second side, opposite to the first side, of the retard roller.

10. The sheet conveyor according to claim 1, wherein the clutch is located upstream of the first torque limiter in the first drive train.

11. The sheet conveyor according to claim 1, wherein the second torque limiter is closer than the first torque limiter to the retard roller.

12. The sheet conveyor according to claim 1, wherein the retard roller is disposed between the first torque limiter and the second torque limiter.

13. The sheet conveyor according to claim 1, wherein the separation roller and the clutch are disposed along the first axis, and wherein the first torque limiter, the retard roller, the one-way clutch, and the second torque limiter are disposed along a second axis parallel to the first axis.

14. An image forming apparatus comprising:

an image forming unit configured to form an image onto a sheet; and a sheet conveyor including a separation roller, a retard roller forming a nip with the separation roller, a load application device configured to apply a load to the retard roller, the load application device including a motor, a first drive train including a plurality of gears for transmitting a driving force from the motor to the retard roller, a first torque limiter configured to communicate with one of the plurality of gears to generate a first load, a clutch disposed between the motor and the first torque limiter, the clutch being connected to the motor via a drive train including a plurality of gears, a second torque limiter isolated from the first drive train and configured to communicate with the retard roller to apply a second load to the retard roller, and a controller configured to, during conveyance of a sheet, control the clutch to allow transmission of the driving force from the motor for a predetermined time period and to interrupt transmission of the driving force from the motor after expiration of the predetermined time period, and a one-way clutch disposed between the retard roller and the second torque limiter isolated from the first drive train, the one-way clutch being configured to allow the retard roller to rotate, wherein, while the clutch allows the transmission of the driving force, the first torque limiter of the first drive train applies the first load to the retard roller, and the second torque limiter isolated from the first drive train applies the second load to the retard roller, and wherein, while the clutch interrupts transmission of the driving force, the retard roller becomes free from the first load and only the second load is applied to the retard roller.

* * * * *